US009591914B2

(12) United States Patent
Reukema et al.

(10) Patent No.: US 9,591,914 B2
(45) Date of Patent: Mar. 14, 2017

(54) SAFETY TETHER

(71) Applicants: Brian Christopher Reukema, Southlake, TX (US); Melissa Christine Reukema, Southlake, TX (US)

(72) Inventors: Brian Christopher Reukema, Southlake, TX (US); Melissa Christine Reukema, Southlake, TX (US)

( * ) Notice: Subject to any disclaimer, the term of this patent is extended or adjusted under 35 U.S.C. 154(b) by 0 days.

(21) Appl. No.: 14/915,886

(22) PCT Filed: Jul. 9, 2014

(86) PCT No.: PCT/US2014/045861
§ 371 (c)(1),
(2) Date: Mar. 1, 2016

(87) PCT Pub. No.: WO2015/030936
PCT Pub. Date: Mar. 5, 2015

(65) Prior Publication Data

US 2016/0198837 A1 Jul. 14, 2016

Related U.S. Application Data

(60) Provisional application No. 61/872,794, filed on Sep. 2, 2013.

(51) Int. Cl.

| | |
|---|---|
| ***A45F 5/00*** | (2006.01) |
| ***A61J 9/06*** | (2006.01) |
| ***A45F 5/02*** | (2006.01) |

(52) U.S. Cl.
CPC ..... *A45F 5/00* (2013.01); *A45F 5/021* (2013.01); *A61J 9/06* (2013.01); *A61J 9/0646* (2015.05); *A61J 9/0661* (2015.05); *A45F 2005/006* (2013.01); *A45F 2200/0583* (2013.01)

(58) Field of Classification Search
CPC ... Y10T 24/13; Y10T 24/141; Y10T 24/1498; Y10T 24/33; Y10T 24/3987
USPC ..... 248/500, 505, 309.1; 224/148.4, 148.5, 224/148.6
See application file for complete search history.

(56) References Cited

U.S. PATENT DOCUMENTS

| | | | | |
|---|---|---|---|---|
| 5,843,168 A * | 12/1998 | Dang | A61F 2/88 | 606/194 |
| 5,946,728 A * | 9/1999 | Tane | A44C 15/001 | 132/273 |
| 6,485,324 B1 * | 11/2002 | Belknap | H01R 13/5804 | 439/369 |
| 6,971,612 B1 * | 12/2005 | Wilson-Lowery | A61J 9/06 | 248/104 |

(Continued)

*Primary Examiner* — Steven Marsh
(74) *Attorney, Agent, or Firm* — Jeffrey Roddy

(57) ABSTRACT

A constriction resistant tether for a child's article includes an elastomeric body, preferably constructed of any FDA approved food grade or higher grade semi-rigid elastomer. A portion of the tether body has a zig-zag, or modified serpentine shape that resembles a non-coiled tension spring. At one end of the body is an anchoring member for securement to a point of attachment such as a child seat, high chair or wheelchair. The anchoring member may possess a small annulus with a tail having spaced knobs along its length extending therefrom, or the anchoring member may be a plug or bulbous member that snaps into or interlocks with a custom sized and shaped aperture defining an attachment point.

5 Claims, 11 Drawing Sheets

(56) References Cited

U.S. PATENT DOCUMENTS

| | | | | | |
|---|---|---|---|---|---|
| D596,747 | S | * | 7/2009 | Freeland | D24/199 |
| D628,703 | S | * | 12/2010 | Rodriguez | D24/199 |
| D722,726 | S | * | 2/2015 | Reukema | D29/101.1 |
| 2009/0134112 | A1 | * | 5/2009 | Reeves | B65D 55/16<br>215/11.6 |

* cited by examiner

110

100
114
112
4
4
115
122
120
118
116

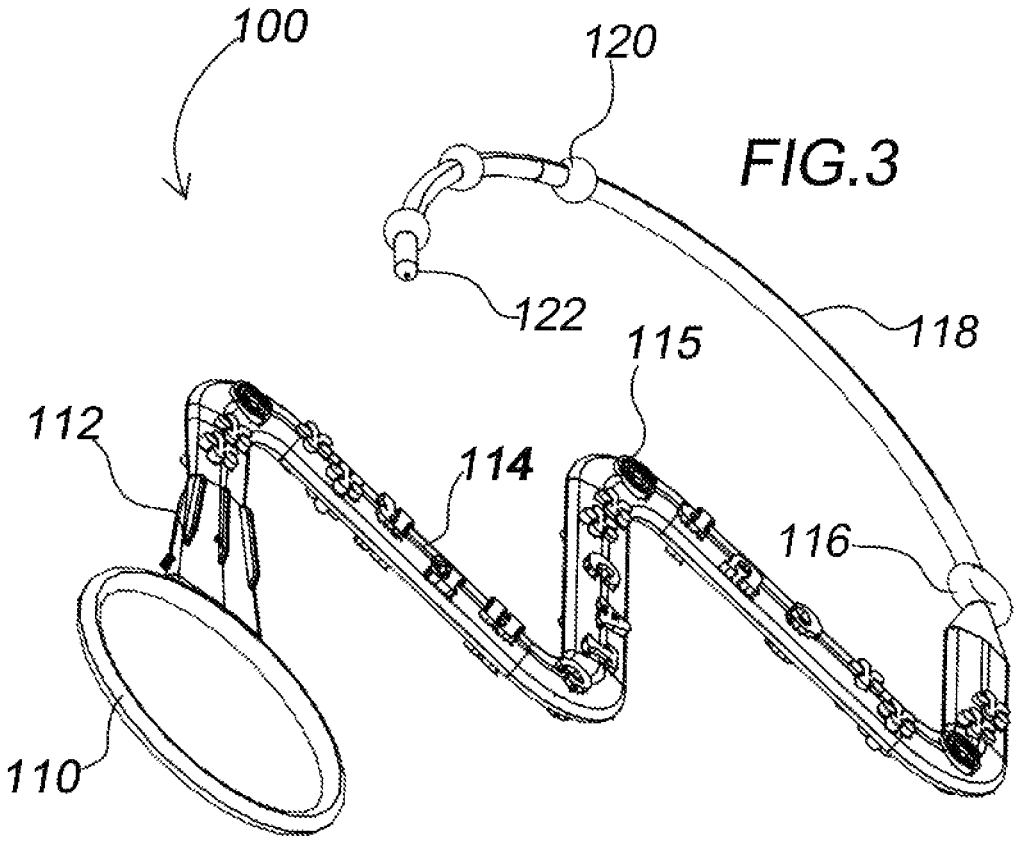
FIG.3
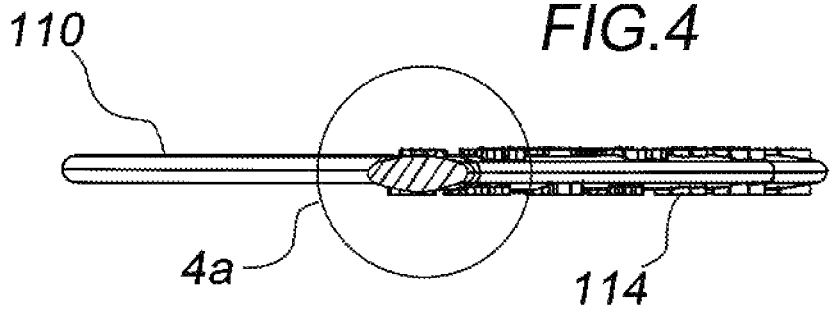
FIG.4
FIG.4a
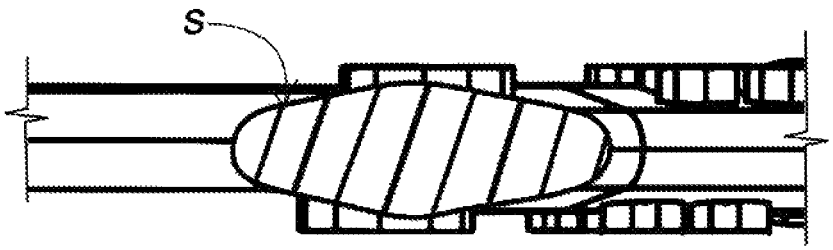

SAFETY TETHER

CROSS-REFERENCE TO RELATED APPLICATIONS

This Application is a National Stage Application of PCT US14/45862 titled Safety Tether filed Jul. 9, 2014, which claims benefit of U.S. Provisional App. No. 61/872,794 having a 371 (c) date of Sep. 2, 2013.

FIELD

The present invention relates generally to an apparatus for safely tethering an article such as a sippy cup or a bottle, and more particularly to a sanitizable tether that is resistant to knotting and constriction.

BACKGROUND

Bottle and cup tethers and leashes of various design have been described in the past. Typically such devices are in the form of a fabric strap with loops at each end. Conventional straps are subject to knotting, and undesirably snag on or between articles such as child seats and high chairs. U.S. Patent Publication No. 20060163301 by Rhodes et al. discloses a bottle tethering device with interconnected straps having open loops with buckles to adjust the diameter of the loops. U.S. Patent Publication No. 20080296325 by Tepper discloses a bottle/can holder that includes a strap of nylon webbing which possesses open loops with hook and loop closure means at the ends. U.S. Patent Publication No. 20090000083 by Richard et al. discloses a toy tether including an elastic strap with open loops having either hook and loop closure means or button or snap closure means at each end.

While the aforementioned devices are capable of tethering a bottle or sippy cup to an attachment point such as the arm rest of a car seat, configurations including conventional straps, buckles and fasteners are soiled easily by liquids or food. Hook and loop type fasteners frequently employed by past tethers are readily unfastened by toddlers. In addition to the foregoing inconveniences, a troubling problem is the constriction hazard posed by devices incorporating straps of any length. What is needed is a safe bottle and cup tether that possesses among other features, an easily cleaned surface, is readily transportable, and can be adapted to fit to sippy cups and bottles of various design.

It would be desirable to provide a bottle and cup tether that exceeds the utility of past tethers by resisting soiling, is sanitizable and possesses an elastic article retention member that prevents retained articles from being thrown or discarded by a child.

It would be further desirable to provide a cup and bottle tether that is flexibly extendable so that children can bring the tethered cup to their mouth without having the tether catch, tangle or hang on other articles.

It would be especially desirable to provide a cup and bottle tether having the foregoing desirable features that in addition, naturally resists accidental constriction about a body part such as a child's wrist or neck and can spontaneously unravel due to its physical characteristics.

SUMMARY

The present invention is a constriction resistant tether that includes an elastomeric body, preferably constructed of any FDA approved food grade or higher grade semi-rigid elastomer with a shore durometer between 40 A and 70 A. A portion of the tether body has a zig-zag, or modified serpentine shape that resembles a non-coiled tension spring. At one end of the body is an anchoring member for securing to an attachment point such as a child seat, high chair or wheelchair. The anchoring member of a preferred embodiment may possess a small annulus with a tail having spaced knobs along its length extending therefrom, or the anchoring member may be a plug or bulbous member that snaps into or interlocks with a custom sized and shaped aperture defining an attachment point. An adjustably sized loop is formed and tightened by threading the knobbed tail through the small annulus which possesses an inner diameter less than the diameter of the tail knobs. At an opposite end of the body is a relatively larger annulus for placement over and around a cup or bottle lip, or between a sippy cup or bottle and a paired cap or threaded nipple retention ring. In use, the tether retains the tethered article close to an attachment point such as a car seat arm rest, seat belt or stroller while being sufficiently extendable to permit a child to manipulate the tethered article retained by the larger annulus for drinking purposes. Unlike hook and loop fasteners, the larger annulus will not accidentally release the tethered article when thrown by a child nor will the anchoring member separate from the anchoring point under normal conditions; e.g., when pulled by a child.

When slack and laid on a planar surface, the tether assumes a flat state; i.e. without colis, or kinks. When stretched, the tether body twists at points along its length where it changes direction so that no planar surface is presented and the tether cannot effectively constrict about a body part. In other words, the tether when stretched and wound about an object produces a discontinous contacting surface that prevent it from becoming a tourniquet. In addition, the tether body resists getting caught or snared due to its alternating angular sections, that unlike straight straps, do not easily slide and wedge between adjacent structures, such as between a car seat belt and seat cushion. Unlike coils, in normal use, the tether cannot tangle itself or form a knot.

In one aspect of the present invention, a closed cell elastomeric tether for articles such as sippy cups and bottles, possesses a body with a zig-zag shape that resists tangling, binding and knotting, a tamper resistant loop for attachment to a bottle or sippy cup at one end, and an adjustable loop at the opposite end for securement to a child's seat, stroller frame or seat belt.

In another aspect of the present invention, a sanitizable elastomeric tether for articles possesses a body with a deformable annulus for affixing to a cup or bottle and an anchoring member which can be an adjustable loop, bulbous member or plug at an opposite end of the body for coupling to an object such as a car seat.

In another aspect of the present invention, a tether possesses a zig-zag shape that when stretched, distorts so that a substantially non-planar contacting surface is presented which prevents the tether from forming a sealing tourniquet when wound around a body part.

While the present invention has been shown in reference to tethering childrens articles of various kinds, it should be noted that the physically and mentally challenged can benefit from it, especially those persons who have difficulty controlling their extremities.

The foregoing and other objects, features, and advantages of the invention will become more apparent from the following detailed description, which proceeds with reference to the accompanying figures wherein the scale depicted is approximate.

BRIEF DESCRIPTION OF THE DRAWINGS

FIG. 3 is a perspective view of a preferred embodiment according to the present invention;

FIG. 4 is a cross-sectional view of the preferred embodiment shown in (FIG. 1) taken along lines 4-4;

FIG. 4*a* is a detail view of call out (4*a*) of (FIG. 4);

DETAILED DESCRIPTION OF THE INVENTION

Reference Listing

Figure 1:
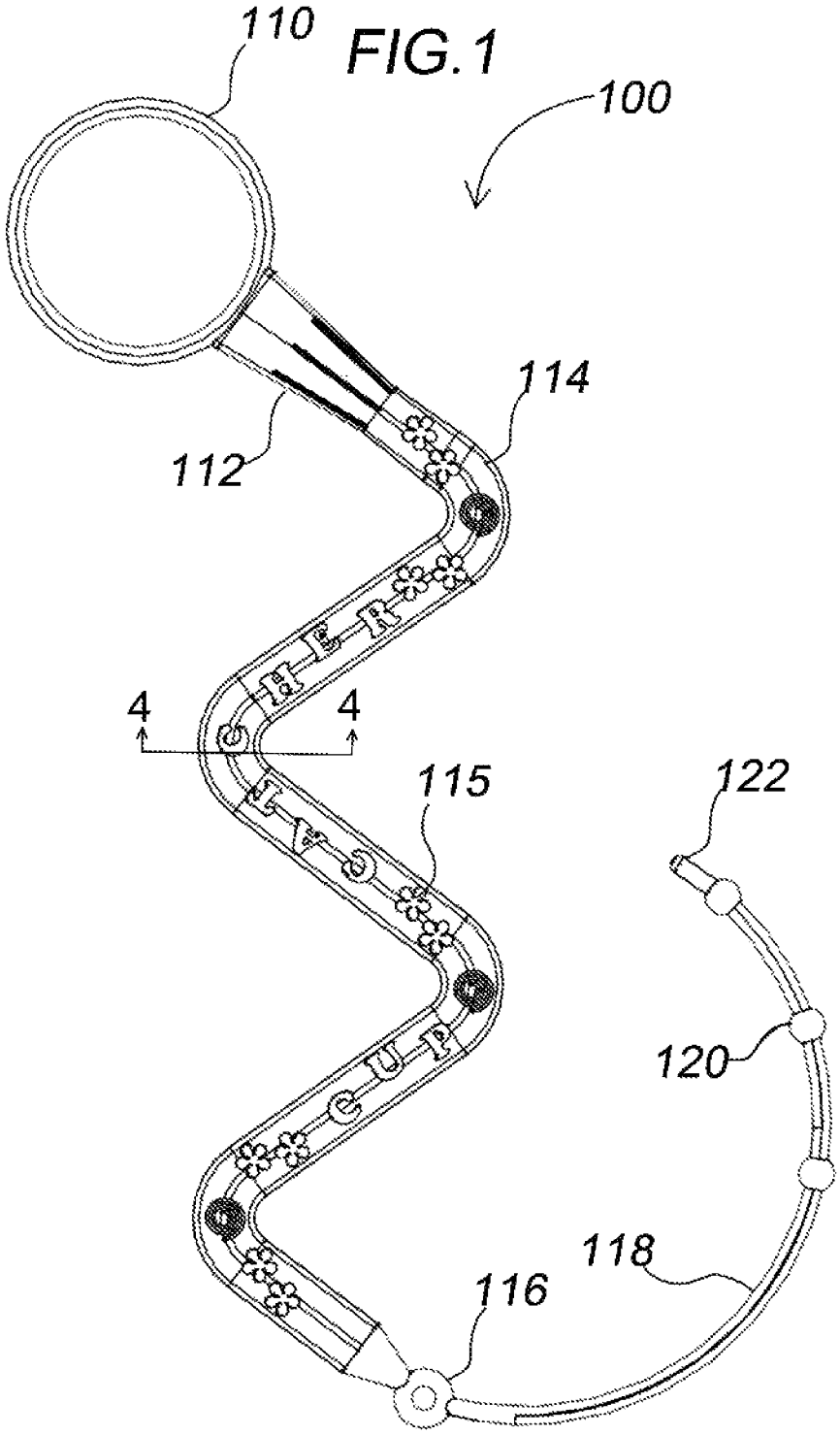
FIG. 1 is a plan view of a preferred embodiment of the present invention with a zig-zag shaped body 114, a relatively small annulus 116, and a larger annulus 110.

100 cup tether
110 annulus
112 neck
114 body
115 texture/indicia
116 small annulus
117 plug
118 tail
120 knob
122 tail end
124 retained article
126 lid or cap
128 attachment point

DEFINITIONS

In the following description, the term "cup or bottle tether" refers to tethers used to retain sippy cups and/or bottles within reach of a child. The term "tethered article" refers generally to any small tethered article, and more specifically to sippy cups and bottles which are often thrown by young children. The term "elastomer" means a resilient polymer with elastic properties. The term "zig-zag" as used herein, refers to a length of tethering material that lays flat when in a relaxed state with angular directional changes along its length. The term "discontinuous" as used herein means having twists, intervals or gaps resulting from stretching or extension. The term "modified ellipse" means a generally elliptical shape with portions along the longer sides which are truncated; e.g., cut short, or flattened. The term "modified rhombus" means a rhombus where the acute or obtuse angles may be rounded. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1 through 10, a tether 100 for safely retaining a sippy cup or bottle among other articles, includes a body 114 having generally a zig-zag shape. While the preferred embodiment depicted herein lays flat when in a relaxed state with substantially coplanar angular shape changes, it is conceivable that the tether can possess zig-zag angles that are slightly offset from a single plane. In any case, when the tether is stretched, it no longer substantially planar because of induced twist at points in the zig-zag body where the tether changes direction. A neck 112 joins annulus 110 for retaining a bottle or cup resides at one end of the body. A relatively smaller annulus 116 resides at an opposite end of the body. Extending from the smaller annulus is a flexible tail 118 having a plurality of evenly spaced knobs 120 thereon which have a slightly larger diameter than the inner diameter of the smaller annulus. While in the preferred embodiment shown, the body possesses raised shapes, ribs and indicia for teething and gripping purposes, raised projections, various decorations or indicia can be absent from or added to the body without departing from the present invention.

Figure 2:
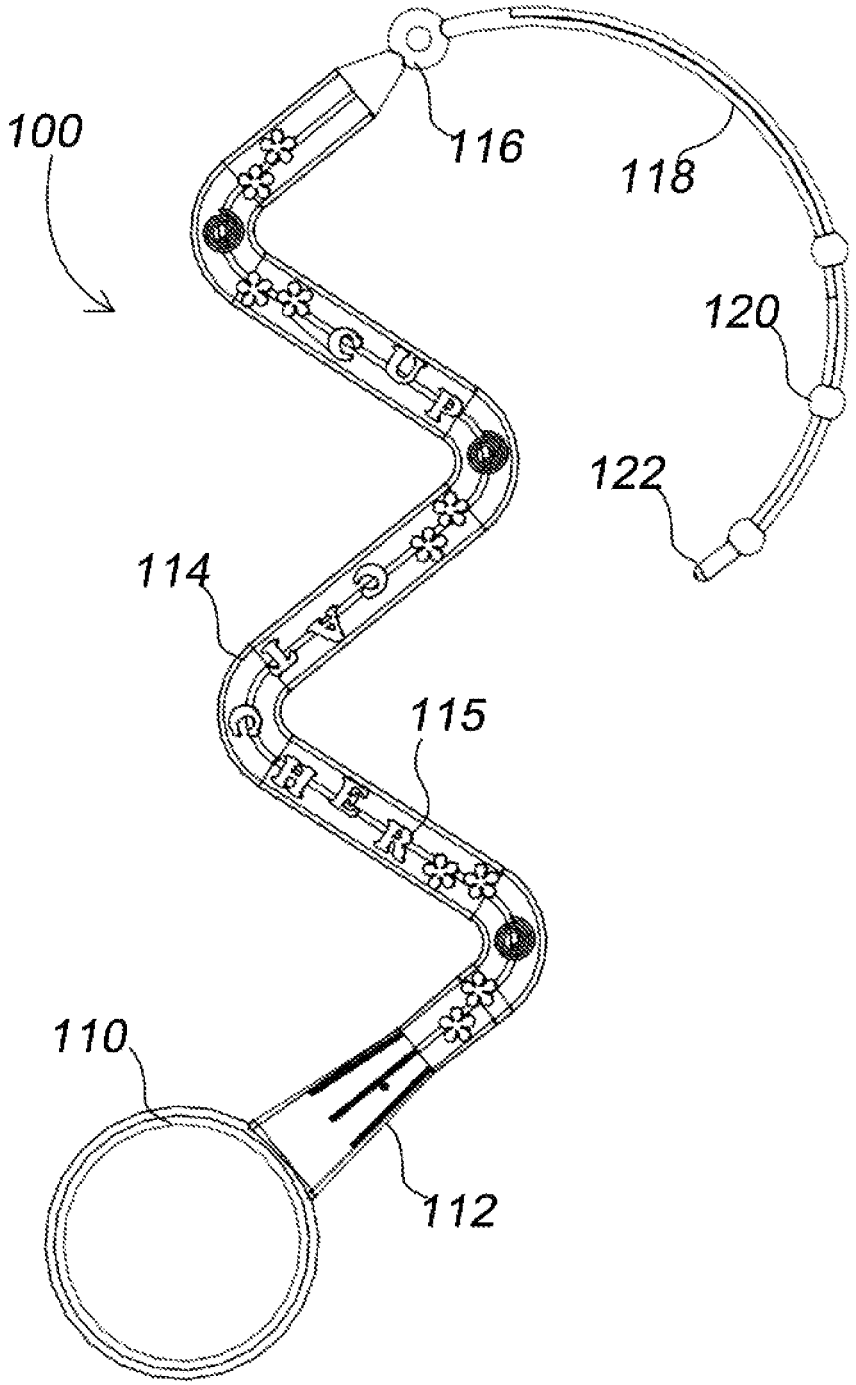
FIG. 2 is a plan view showing the opposite side of that shown in (FIG. 1)

FIGS. 1 and 2 in plan views depict opposite sides of a preferred embodiment in an unstretched state. The length of tether 100 in an unstretched state is preferably between 8 and 18 inches. While annulus size can vary according to application, unstretched annulus 110 is approximately 2 inches in diameter and is capable of stretching to approximately 3 inches in diameter without breaking. Extendability will vary according to shore value of the tether elastomer.

FIG. 3 is a perspective view of tether 100 in an unstretched state wherein annulus 110, neck 112, body 114, annulus 116 and tail 118 are generally coplanar.

FIG. 4 is a cross-sectional view taken along lines 4-4 of (FIG. 1). FIG. 4*a* is a detail view of call-out 4*a* of (FIG. 4). While in the preferred embodiment shown, the cross-section of body 114 is a modified rhombus with rounded obtuse and acute angles(s), other cross-sectional shapes, e.g., elliptical or rectangular, that promote the transformation of the tether from a substantially planar article to one substantially non-planar when stretched may be employed without departing from the claimed invention.

Figure 5:
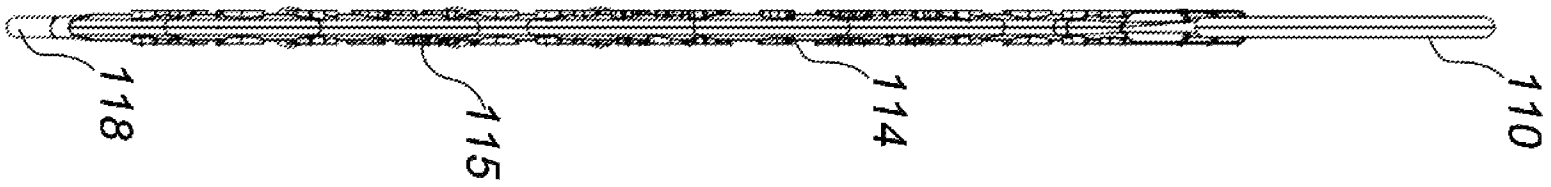
FIG. 5 is an edge view of the preferred embodiment shown in (FIG. 3) with larger annulus 110 at top.
Figure 6:
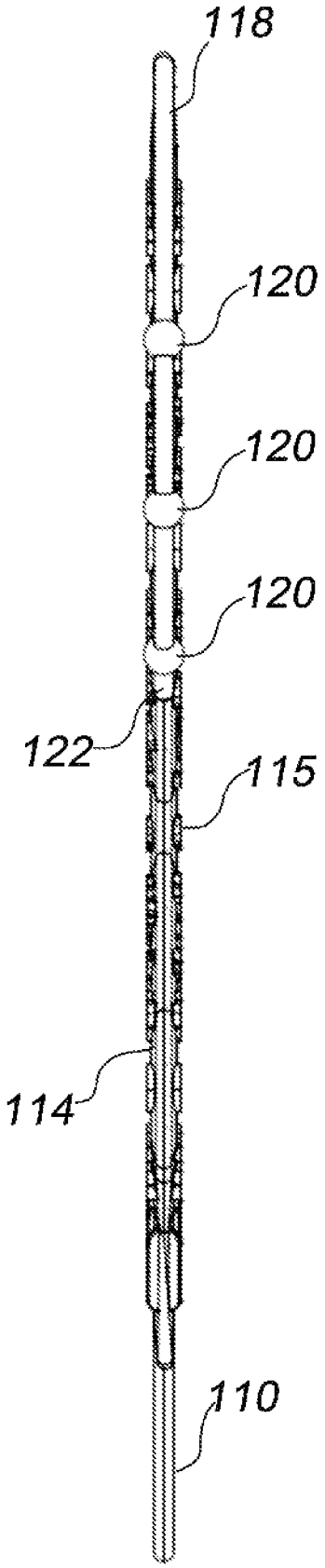
FIG. 6 is an edge view of the preferred embodiment shown in (FIG. 3) with larger annulus 110 at bottom.

FIGS. 5 and 6 show edge views of the tether wherein raised shapes 115 are on body 114. While preferably for sanitization and durability purposes, the tether is one-piece molded construction, it is conceivable that other processes can be employed in making the article.

Figure 7:
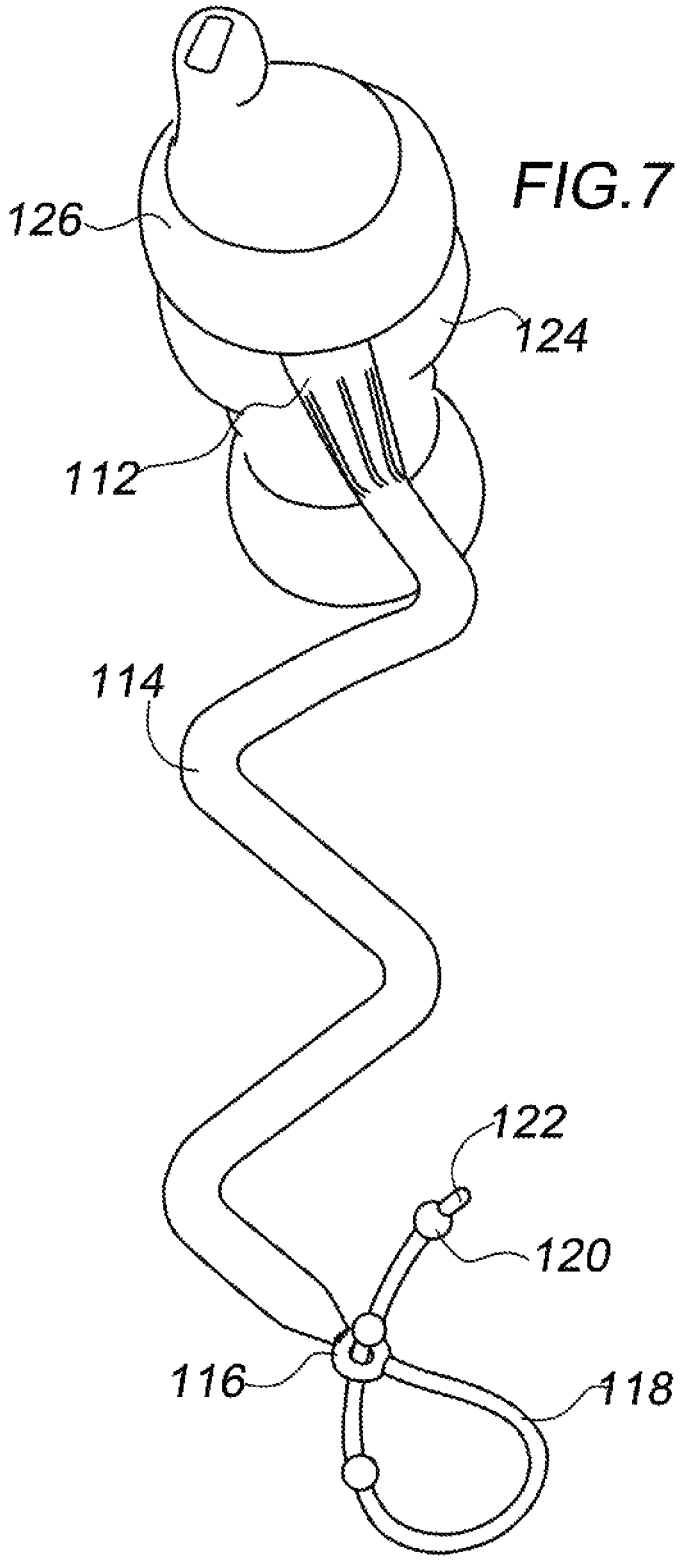
FIG. 7 is a perspective view of a preferred embodiment in a un-stretched state with larger annulus 110 about a sippy cup and showing a looping means an end opposite the sippy cup.
Figure 8:
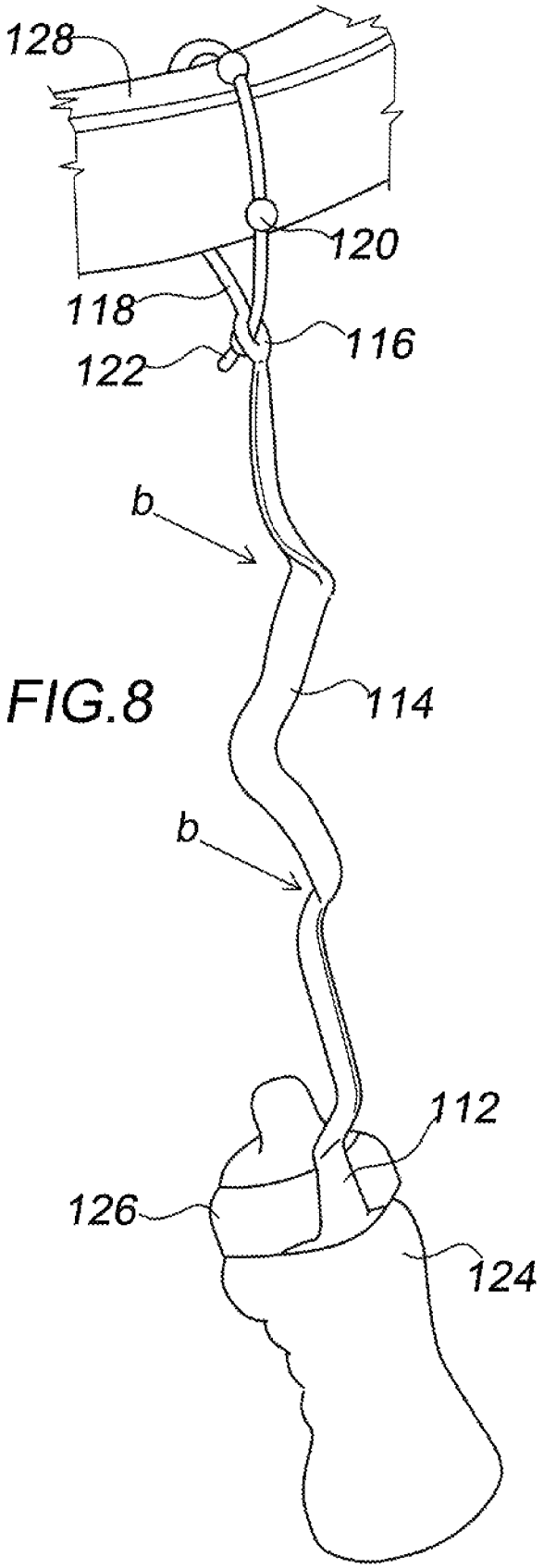
FIG. 8 is a perspective view of a preferred embodiment in a stretched state with larger annulus 110 about a sippy cup and showing an adjustable loop about attachment point 128.

FIGS. 7 and 8 depict a preferred embodiment in typical use. FIG. 7 shows a sippy cup with annulus 110 having been slipped over the cup body and nesting between the cup body and the lid. Typically sippy cups and bottles have a threaded lip, and annulus 110 is sufficiently elastic to stretch over the threads of various sizes and shapes of containers. As shown, tail 118 has a number of knobbed projections, the largest diameter of each knob being slightly larger than the inner diameter of smaller annulus 116. Tether 100 is affixed to an attachment point by looping tail around the attachment point and threading tail end 122 through annulus 116 which deforms slightly when the knobs are pulled therethrough. Reversing this action unaffixes the tether from the attachment point. While in the preferred embodiment, the knobs are generally spherical, being sufficiently resistant to children, while still pliant enough so that an adult can unfasten the loop, other knob shapes such as elliptical solids, conic solids and others will suggest themselves to those having skill in the art and benefit of this disclosure.

Referring particularly to FIG. 8, tether 100 is shown in a stretched state wherein it is transformed from a substantially planar article to a substantially non-planar article having a surface with intermittent twists (b) that yields a form that resists constriction about a body part. It should be noted that while the tether is elastic, it is a semi-rigid elastomer with shore durometer between 40 A and 70 A, not like a rubber band of typically 25 A, and therefore, unlike a rubber band, the twists (b) cannot be stretched to form a continuous, or an even surface. Unlike an elastic coil, it cannot become tangled with itself or be stretched to form a constricting element.

Figure 9:
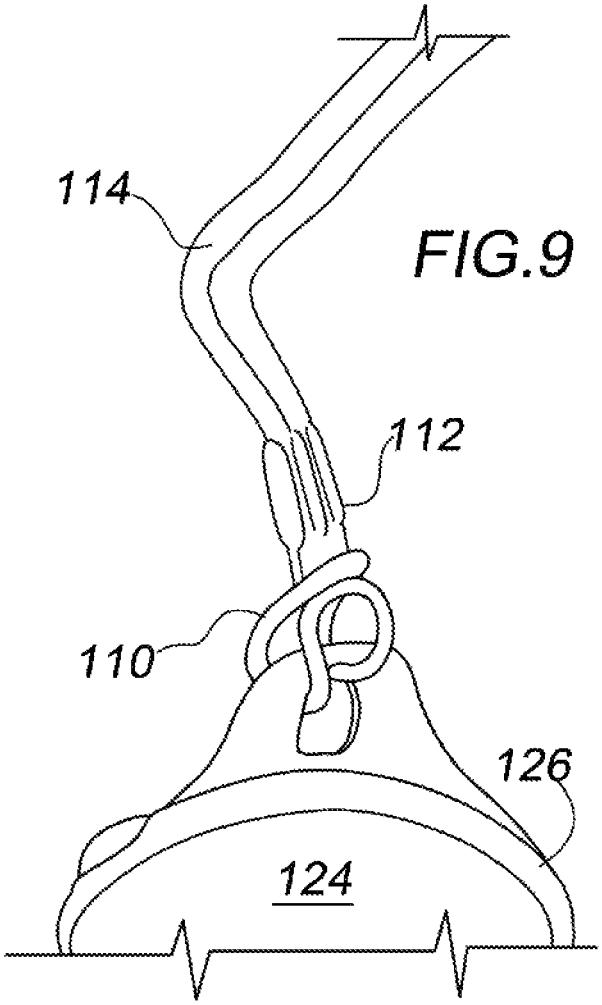
FIG. 9 is a partial view of annulus 110 placed through an aperture or loop of a sippy cup and with body 114 passed through annulus 110.

FIG. 9 depicts an alternative tethering method employable by the present invention wherein annulus 110 is first inserted through an aperture or loop of a sippy cup, bottle, teether ring, snack container or toy, after which body 114 is then threaded through annulus 110 in order to secure the article.

Figure 10:
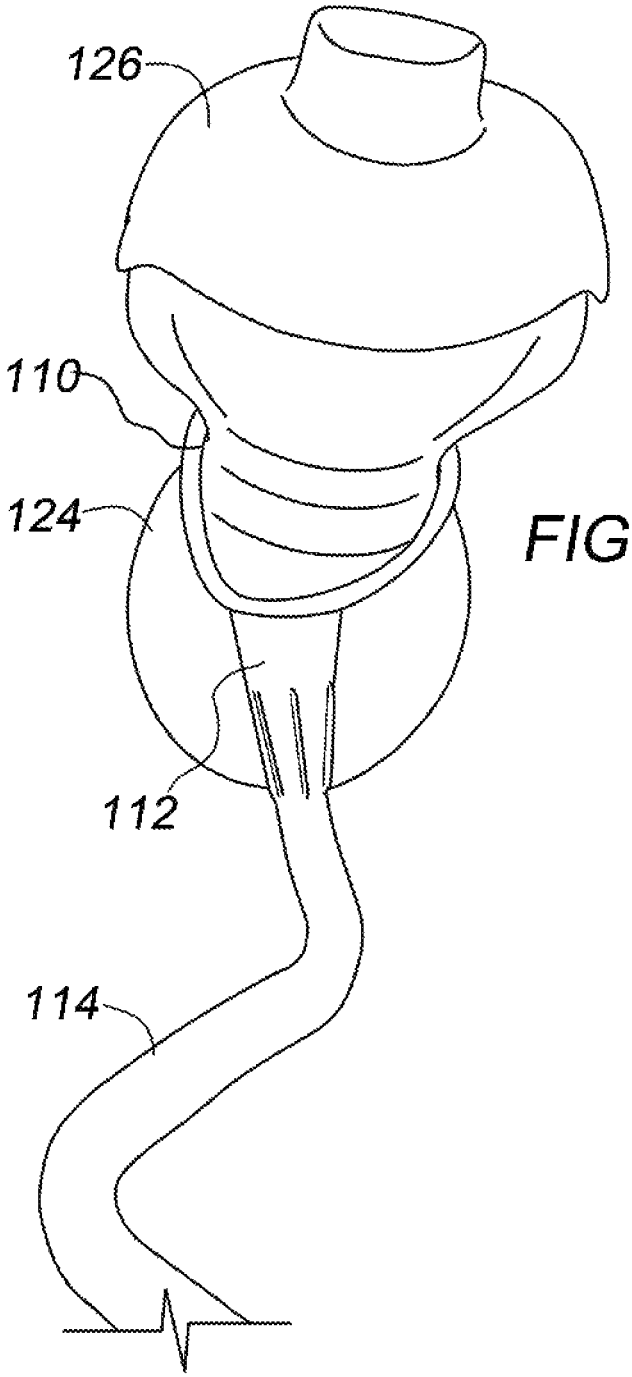
FIG. 10 is a partial view showing annulus 110 placed over the midsection of a sippy cup.

While annulus 110 typically resides between the cup or bottle and a cap retention ring as depicted in (FIG. 8), it can simply be stretched over circumferentially about the body of a tethered article as shown in FIG. 10.

Figure 11:
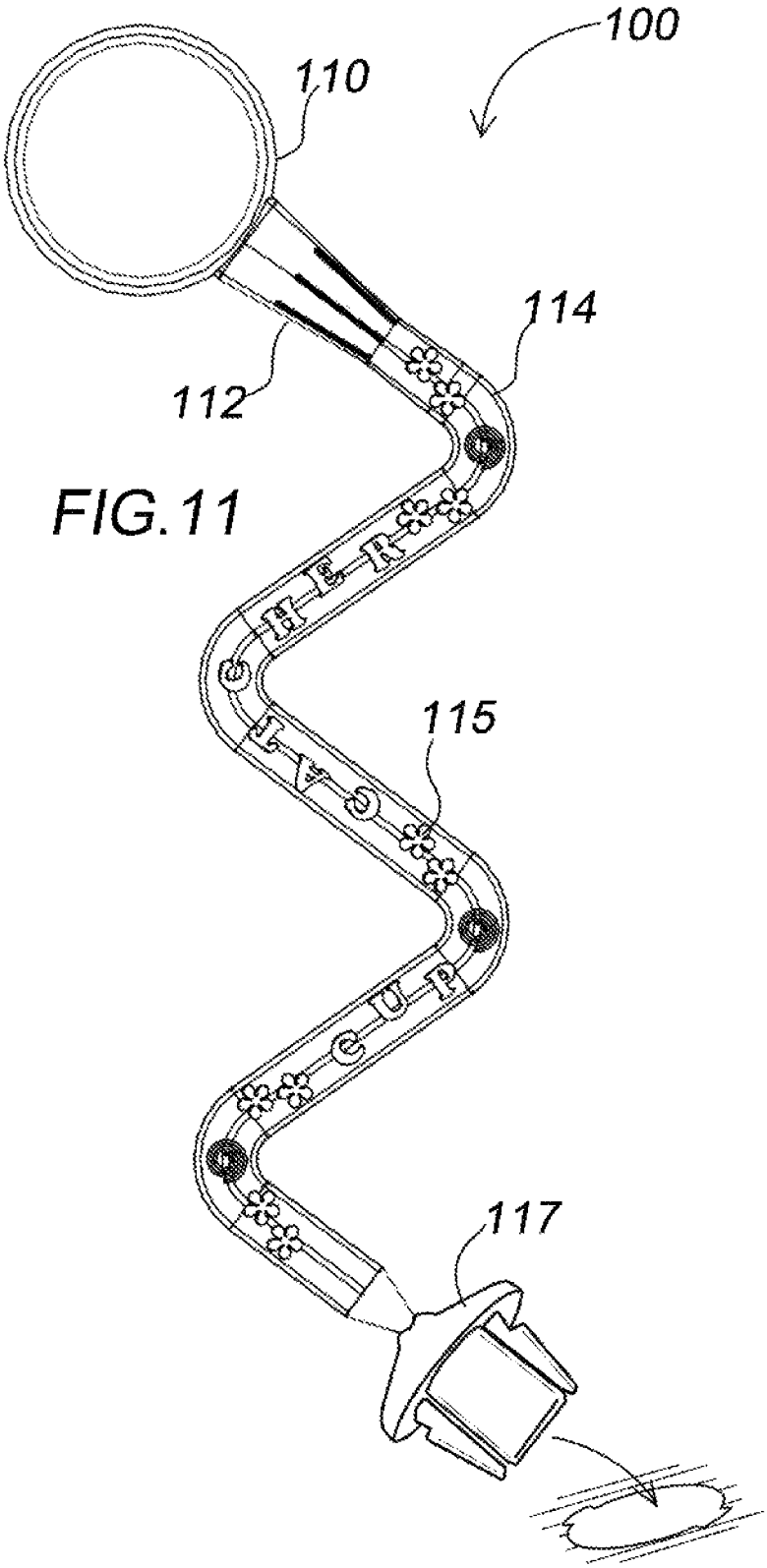
FIG. 11 depicts a alternative embodiment having a plug 117 adapted to fit into an aperture shaped and sized therefor which can be a part of a larger assembly such as a child seat or toy.

FIG. 11 depicts one preferred embodiment in which the smaller annulus 116 is replaced by a plug or bulbous member 117. Although the particular plug shown has fins or projections that compress and then expand when inserted into a mating aperture, other anchoring members will suggest themselves to those having skill in the art and benefit of this disclosure.

Figure 12A:
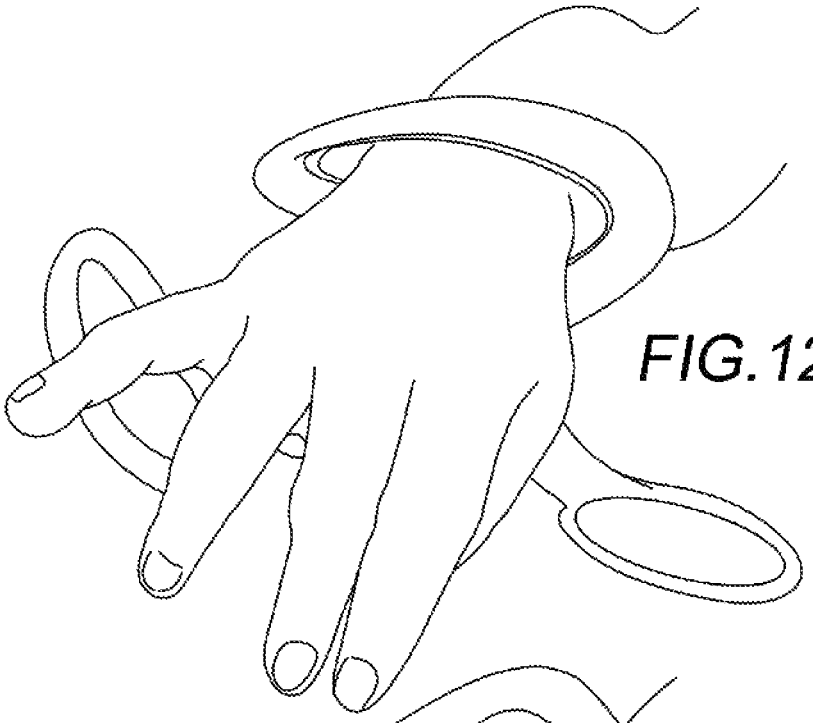
FIGS. 12A and 12B show the tendency of the tether to spontaneously unravel and resist tangling when wound around an object.
Figure 12B:
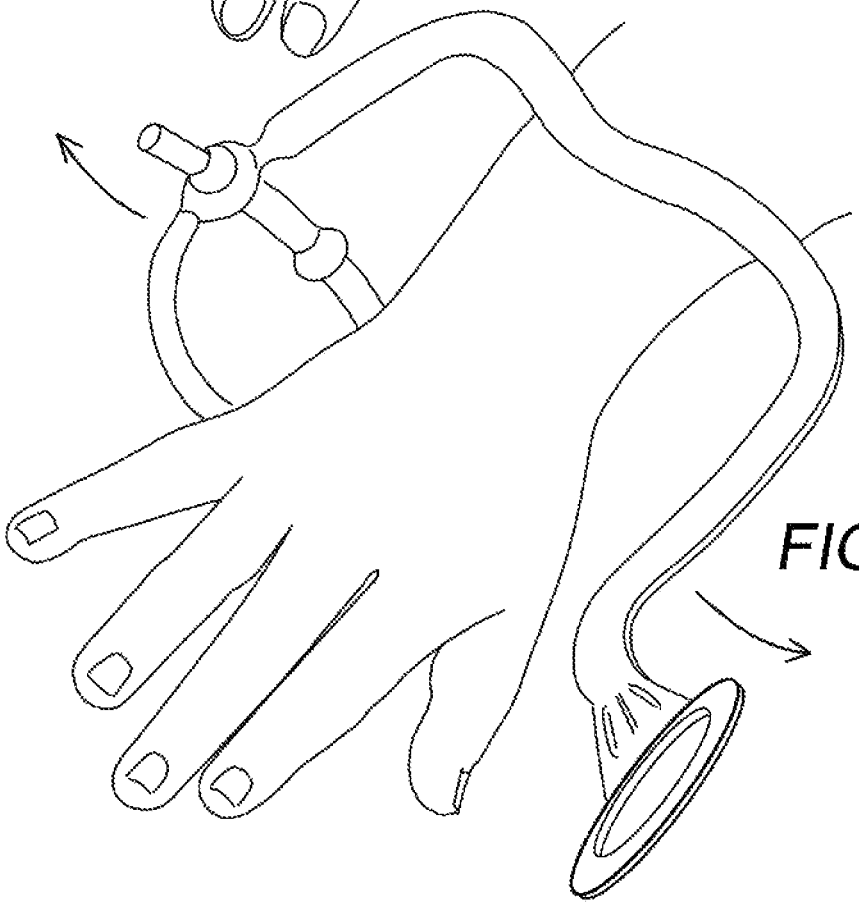

FIGS. 12*a* and 12*b* show in sequential order, tether 100 placed about a child's wrist and a natural unraveling and straightening of the tether that occurs when the child moves his or her wrist.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

We claim:

1. A tethering device for retaining articles manipulated by children comprising:

(1) a slender non-coiling elastomeric body having substantially a zig-zag shape that when stretched, twists at points along its length where the elastomeric body changes direction to produce a discontinuous surface along its length that resists tourniqueting, and, (2) at one end of the elastomeric body, an elastic annulus for placement over an article, and at an opposite end of the elastomeric body, an attachment member for attaching the device to an object.

2. The device according to claim 1, wherein the tether body is made of a sanitizable polymer.

3. The device according to claim 1, wherein when the elastic annulus is sized for fitting over beverage containers.

4. The device according to claim 1, wherein a transverse cross-section of the body is derived from at least one of the following: ellipse, rectangle, rhombus.

5. The device according to claim 1, wherein the elastomeric body possesses a shore durometer between 40 A and 70 A.

* * * * *